US007305970B2

(12) United States Patent
Augesky

(10) Patent No.: US 7,305,970 B2
(45) Date of Patent: Dec. 11, 2007

(54) CIRCUIT CONFIGURATION AND METHOD FOR GENERATING A CONTROL SIGNAL FOR AN ENGINE CONTROL UNIT DESIGNED TO CONTROL FUEL INJECTORS

(75) Inventor: Christian Augesky, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/587,495

(22) PCT Filed: Jan. 14, 2005

(86) PCT No.: PCT/EP2005/050148

§ 371 (c)(1),
(2), (4) Date: Jul. 26, 2006

(87) PCT Pub. No.: WO2005/071248

PCT Pub. Date: Aug. 4, 2005

(65) Prior Publication Data

US 2007/0157905 A1 Jul. 12, 2007

(30) Foreign Application Priority Data

Jan. 26, 2004 (DE) ..... 10 2004 003 837

(51) Int. Cl.
*F02M 51/00* (2006.01)

(52) U.S. Cl. ..... 123/478; 123/480

(58) Field of Classification Search ..... 123/478, 123/480

See application file for complete search history.

(56) References Cited

U.S. PATENT DOCUMENTS 4,048,965 A 9/1977 Bianchi et al.
4,100,891 A * 7/1978 Williams ..... 123/487
4,130,095 A * 12/1978 Bowler et al. ..... 123/675
4,212,066 A * 7/1980 Carp et al. ..... 701/103
4,235,204 A * 11/1980 Rice ..... 123/674
4,255,789 A * 3/1981 Hartford et al. ..... 701/108
4,264,898 A * 4/1981 Barman et al. ..... 341/141
4,307,450 A * 12/1981 Carp et al. ..... 701/103
4,714,066 A * 12/1987 Jordan ..... 123/447
5,937,808 A * 8/1999 Kako et al. ..... 123/90.15

(Continued)

FOREIGN PATENT DOCUMENTS

DE 24 57 461 6/1976

(Continued)

*Primary Examiner*—John T. Kwon
(74) *Attorney, Agent, or Firm*—Laurence A. Greenberg; Werner H. Stemer; Ralph E. Locher

(57) ABSTRACT

A circuit configuration for generating a control signal for an engine control unit, designed to control at least one fuel injector of an internal combustion engine, enables an improved control signal course during the control of the injectors. The configuration includes: a counter device, to which a predefined clock signal can be supplied, for providing a time-dependent digital counter signal, based on the counting of the clock signal; a memory unit, in which the digital counter signal is entered, for storing a series of digital control signal values and for the successive issue of individual control signal values from the series of control signal values, in accordance with the counter signal; and a digital-to-analog converter for converting the issued digital control signal values into the analog control signal for the engine control unit.

9 Claims, 4 Drawing Sheets

U.S. PATENT DOCUMENTS

| | | | | |
|---|---|---|---|---|
| 6,260,524 | B1 * | 7/2001 | Wachi | 123/90.15 |
| 6,563,252 | B2 | 5/2003 | Schrod | |
| 6,973,919 | B2 | 12/2005 | Joos et al. | |

FOREIGN PATENT DOCUMENTS

| | | | |
|---|---|---|---|
| DE | 199 44 733 | A | 3/2001 |
| DE | 199 58 262 | A1 | 7/2001 |
| DE | 101 48 217 | C1 | 4/2003 |
| EP | 0 158 867 | A2 | 10/1985 |
| WO | WO 03/091559 | A1 | 11/2003 |

* cited by examiner

CIRCUIT CONFIGURATION AND METHOD FOR GENERATING A CONTROL SIGNAL FOR AN ENGINE CONTROL UNIT DESIGNED TO CONTROL FUEL INJECTORS

BACKGROUND OF THE INVENTION

Field of the Invention

The present invention relates to a circuit configuration and also a method for generating a control signal for an engine control unit designed to control a fuel injector of an internal combustion engine.

In particular the exhaust gas standards for engines which have become more stringent in recent times have brought about the development of fuel injectors with fast and instantaneously responding final control elements or actuators in the motor vehicle industry. With regard to the practical realization of such types of final control elements, piezoelectric elements particularly have proved to be advantageous. Such types of piezo elements are usually made up of a stack of piezo ceramic disks which are operated by way of an electrical parallel circuit in order to be able to achieve the electrical field strengths required for an adequate stroke.

The use of piezoelectric ceramic for operation of fuel injection valves of an internal combustion engine places considerable demands on the electronics for charging and discharging the piezo ceramic. In this situation, comparatively high voltages (typically 100V or more) and briefly comparatively high currents for charging and discharging (typically more than 10 A) need to be made available. In order to optimize the engine characteristics (for example exhaust gas values, performance, consumption etc.), these charging and discharging operations should take place in fractions of milliseconds with simultaneously extensive control over current and voltage.

With regard to the engine control units previously used, including a final stage for the operation of one or more piezo fuel injectors, the charging and discharging current forms are more or less predefined by the particular operating principle of the circuit or can only be changed within relatively narrow limits.

Thus, for example, a final stage for controlling piezo fuel injectors is known from DE 199 44 733 A1. This known final stage is based on a bidirectionally operating reverse converter and enables a metering of energy portions when charging and discharging the piezoelectric ceramic of the fuel injectors, such that on principle the charging and discharging current forms can be realized in adapted form as average current waveforms. The desired current waveforms when charging and discharging the piezo elements are defined here by means of a control circuit, not described in detail in this publication, which for this purpose measures the actual charging and discharging currents flowing (with reference to voltage drops at current shunts) and controls the charging and discharging operations based on these measurement values. In order to charge a piezo element a charging switch is controlled with a predefined frequency and predefined pulse duty ratio in pulsed operation with a predefined number of pulse-width modulated signals, whereas in order to discharge a piezo element a discharging switch is controlled in pulse form to be conducting and non-conducting.

If an engine control unit for controlling at least one fuel injector, as are already known in numerous embodiments, is intended to control the fuel injectors in a regulated manner, then a control signal is required for this regulation which represents the "reference value" for a desired timing characteristic with regard to controlling an injector, for example charging or discharging a piezo injector. Particularly as a result of the control operations which occur relatively rapidly, as already mentioned above, extremely simple regulation facilities or reference value control signals have been employed for those engine control units used hitherto. The control waveforms which then result, for example charging and discharging current forms, are not optimal in this respect with regard to piezo injectors.

SUMMARY OF THE INVENTION

The object of the present invention is therefore to set down a way of generating a control signal for an engine control unit for controlling at least one fuel injector of an internal combustion engine, with which improved control signal waveforms can be realized with regard to injector control.

This object is achieved by a circuit configuration according to claim 1 or a method according to claim 10. Advantageous developments of the invention are set down in the dependent claims.

The circuit configuration according to the invention for generating a control signal for an engine control unit for controlling at least one fuel injector of an internal combustion engine comprises:

- a counter device, to which a predefined clock signal can be supplied, for providing a time-dependent digital counter signal, based on the counting of the clock signal, whereby the clock signal is predefined with a frequency which is selectable depending on the modification signal,
- a memory unit, to which the digital counter signal can be supplied, for storing a series of digital control signal values and for the successive issue of individual control signal values from the series of control signal values, in accordance with the counter signal, and
- a digital-to-analog converter unit for converting the issued digital control signal values into the analog control signal for the engine control unit, whereby the conversion of the digital control signal values into the analog control signal is implemented by taking the modification signal into account as an amplitude scaling signal.

It is thus possible in a simple manner to generate a control signal adapted to the particular application situation as a predefined reference value for the regulated control of a fuel injector with practically any desired control waveform (for example charging and discharging current form). Essential in this situation is the storage of a digital series of control signal values, from which individual control signal values are issued in succession during operation of the circuit configuration and converted into the analog control signal. In particular it is thus not necessary, as previously, to accept compromises in respect of the charging and discharging current forms with regard to piezo injectors. Rather, these forms can be optimally adapted to the respective requirements.

As a result of the free definability of the waveforms of charging and discharging currents for piezo injectors and/or the voltages present at such piezo injectors, it is thus possible to comply with the requirements both in respect of a variable stroke size for the piezo actuators and also of the injection duration whilst simultaneously minimizing the acoustic emission. The fuel injectors or the control thereof can be optimized in respect of the desired valve opening and valve closing speeds, the masses moved during opening and closing and the (as a rule non-linear) characteristics of the conversion of an actuator stroke into the valve opening or valve closing (for example hydraulic conversion in the case of a piezo servo valve). In laboratory trials, for example, ideal charging and discharging current curves for piezo servo valves have been determined which run relatively "gently" and for example similar to the "$\sin^2$" function. By using the solution according to the invention, appropriate control signals for predefining reference values can be generated in a simple manner with regard to regulated injector control.

In a preferred embodiment, provision is made whereby the clock signal is predefined with a selectable frequency. The waveform of the corresponding control signal can thus be scaled in time for one and the same stored series of control signal values. Setting a lower frequency then results, for example, in the control signal values being read out at a lower clock frequency (more slowly) from the memory unit. This frequency setting can be used in this situation both for adapting the control signal waveform to the properties of a particular one of a plurality of injectors and also for adapting this control signal waveform to actual operating conditions for the internal combustion engine or injection system in question. Such types of adjustments in this situation can be made in real time without any difficulty.

There are numerous possible ways of setting the clock frequency. For example, a voltage controlled oscillator (VCO) to which a time scaling signal is applied can be used in order to provide the clock signal with the selected frequency. In another embodiment, an oscillator with a fixed oscillation frequency and a divider, connected downstream of the oscillator, is used here whose division ratio is determined by a time scaling signal input to the divider.

By preference, a series of at least 30, in particular at least 50 control signal values, is provided as the series of control signal values stored in the memory unit. A sufficiently precise definition of the control signal waveform results in practice for the majority of cases from using such a number.

With regard to the optimized control curves determined in laboratory trials for the current or for charging in the case of piezo injectors it is advantageous if the series of control signal values stored in the memory unit approaches a continuous function. For predefining the reference value for the charging or discharging current waveform in the case of a piezo injector, a series which approaches a continuous, in particular a continuously differentiable, "bell function" has for example proved to be particularly advantageous. In one embodiment, the series is composed of a monotonically increasing series section and a monotonically decreasing series section, which together approach the bell curve.

With regard to the precision of the definition of the control signal waveform it is advantageous in the majority of applications if the digital control signal values are provided with a resolution of at least 8 bits.

Although it is conceivable that the stored series of control signal values can be changed, for example by using a read/write memory and operational updating of the stored data, then the setup or operation of the circuit configuration is considerably simplified if either one or more selectable series of control signal values is permanently predefined by the stored data. In one embodiment, provision is therefore made whereby the memory unit takes the form of a read-only memory.

It is also possible on the basis of a series of control signal values which is permanently predefined during operation to provide the control signal waveform in variable or adapted form. One possible way of doing this is the aforementioned setting of the frequency of the clock signal, which causes a temporal scaling of the control signal waveform.

As an alternative or in addition, it is for example possible for modification of the control signal waveform to take into consideration an amplitude scaling signal value when providing the conversion of the digital control signal values into the analog control signal. Such an amplitude scaling signal value can for example be entered at a reference input of a digital-to-analog converter which is provided for this purpose, such that the output signal from the converter has its amplitude scaled in accordance with the entered amplitude scaling signal value.

In a preferred embodiment, provision is made whereby a time scaling signal provided for setting the clock signal frequency and an amplitude scaling signal provided for setting the amplitude of the control signal are identical or are derived from one another or from a common scaling signal. It is thus possible, for example, in a particularly simple manner to furnish different charging final values (corresponding to different strokes of a piezo injector) when the charging time or discharging time is also scaled.

Finally, the control signal waveform can also be modified, for example, in that the counter device or a digital conversion device connected downstream of the counter device is provided in such a way that a re-coding of the counter signal takes place for this modification before it is used as an address signal.

The adaptation of the control signal waveform can for example be provided with regard to manufacturing-dependent tolerances affecting the controlled fuel injectors. It can be the case, for example, that piezo elements incorporated in different fuel injectors require different charging final values during the injector opening process in order to open the injector valve to its full extent. Such types of tolerances can for example be compensated for by providing an appropriately adapted scaling signal. Sensor signals, supplied by so-called position or limit stop sensors of the injector arrangement, which are often available in any case can for example advantageously be used for such an adaptation to the characteristics of a fuel injector or of the final control element used therein. Such types of sensors for the realtime recording of the characteristics and/or the actual course of motion in fuel injectors are adequately known and do not therefore require any detailed description.

Furthermore, for example, the following operating parameters for the internal combustion engine or injection system in question can be evaluated and used for adapting the control signal waveform: pump prepressure (for example rail pressure), temperature (in particular temperature of the injector and/or of the fuel), rotational speed and load of the internal combustion engine etc.

The invention will be described in detail in the following on the basis of several embodiments with reference to the attached drawings. In the drawings:

DESCRIPTION OF THE PREFERRED EMBODIMENTS

Figure 1:
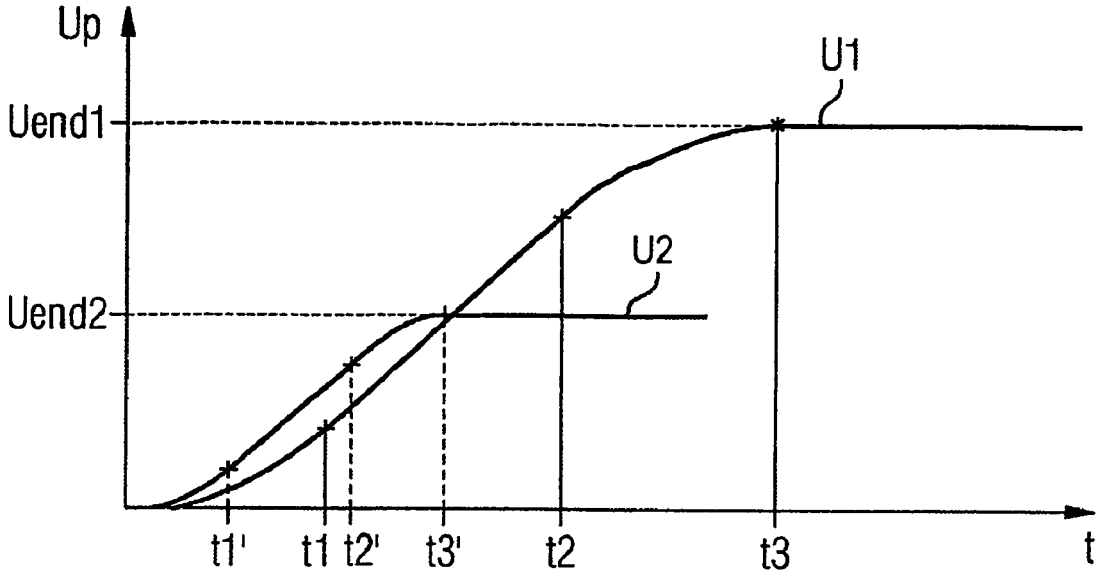
FIG. 1 illustrates a comparison of two waveforms for the control signal (voltage) for a piezo injector.
Figure 2:
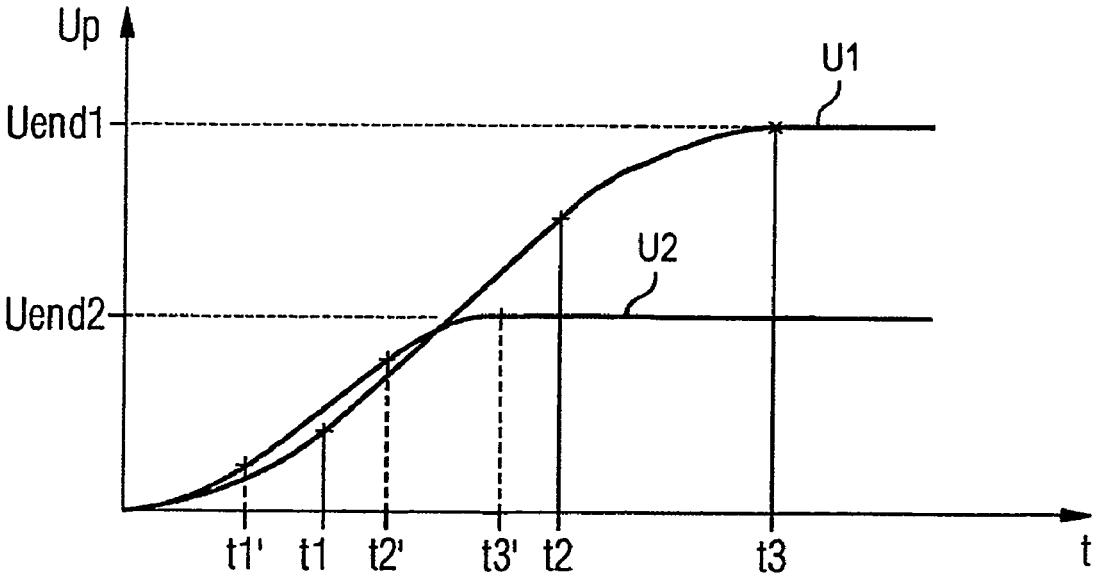
FIG. 2 illustrates a comparison of two further waveforms for the control signal for a piezo injector.
Figure 3:
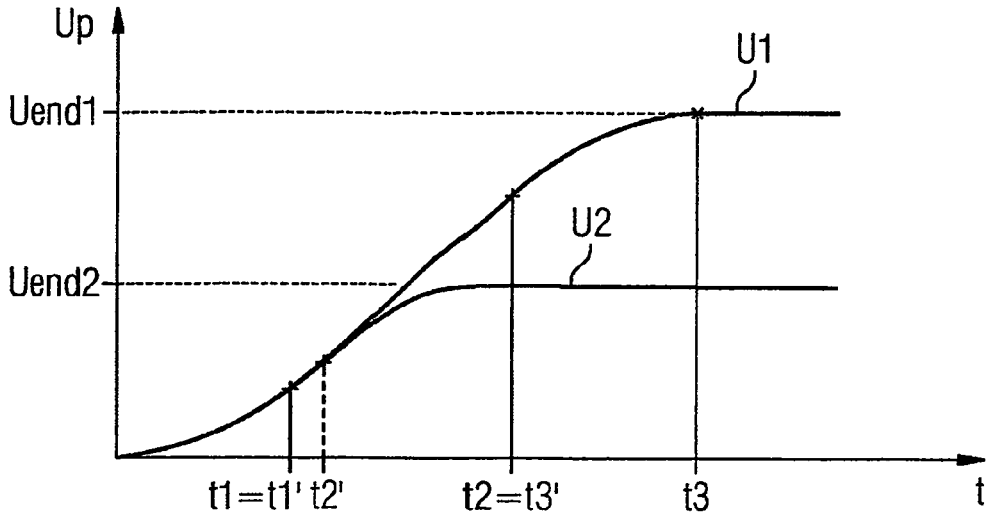
FIG. 3 illustrates a comparison of two further waveforms for the control signal for a piezo injector.

With regard to the waveforms illustrated in FIGS. 1 to 3, these are control voltages as they are applied to the piezo element by an engine control unit of a motor vehicle for opening a fuel injection valve operated by means of a piezo element.

As a result of the predefined electrical capacitance of the piezo element, the waveforms illustrated also correspond to the characteristic of the charge quantity stored into the piezo element.

FIG. 1 shows two voltage curves or waveforms U1, U2 for the piezo voltage Up plotted against the time t. The two waveforms U1 and U2 have different piezo voltage final values Uend1 and Uend2, whereby in the example illustrated the final voltage Uend2 of the piezo voltage curve U2 is half of the voltage final value Uend1 of the piezo voltage curve U1.

The two piezo voltage curves U1, U2 have qualitatively the same shape which namely results for a piezo charging current curve with precisely one maximum similar to the $\sin^2$ function, whereby the curves U1, U2 in the time range are scaled with the voltage final value reached at the end. In the example illustrated this means that the charging time duration denoted by t3' for the curve U2 is half the charging time duration t3 for the curve U1. Accordingly, the times t1' and t2' likewise entered in the figure, at which the piezo voltage Up for the curve U2 reaches 20% and 75% respectively of the voltage end value Uend2, likewise amount to half of the corresponding times t1 and t2 for the curve U1. From this simultaneous scaling of the voltage or charging final value and the charging time results a maximum charging current for the piezo element, equal for both curves U1 and U2, which is expressed in the figure by an equal maximum gradient of the curves U1 and U2.

With regard to the waveforms U1 and U2 these are to a certain extent optimized curves of a qualitatively predefined shape, which on account of the scalability can be employed advantageously for the control of fuel injectors having different control characteristics or for the control of fuel injectors having a variable actuation stroke.

FIGS. 2 and 3 are illustrations corresponding to FIG. 1 for other voltage curves U1 and U2.

As opposed to FIG. 1, FIG. 2 shows an additional scaling (extension) in the time range for the voltage curve U2, as a result of which the charging current needed with this curve is reduced and a shift of the acoustic spectrum to lower frequencies is advantageously achieved.

FIG. 3 shows a further possible option for shaping two voltage curves U1 and U2 with different voltage final values. In this situation the piezo voltages Up take an identical course up to the point in time t1=t1' and deviate from one another until reaching the respective voltage final values Uend1, Uend2.

Circuit configurations for generating a control voltage Us which is suitable as a "reference value" for charging and discharging currents for realization of the piezo voltage curves illustrated in FIGS. 1 to 3 are described in the following with reference to FIGS. 4 to 6.

Figure 4:
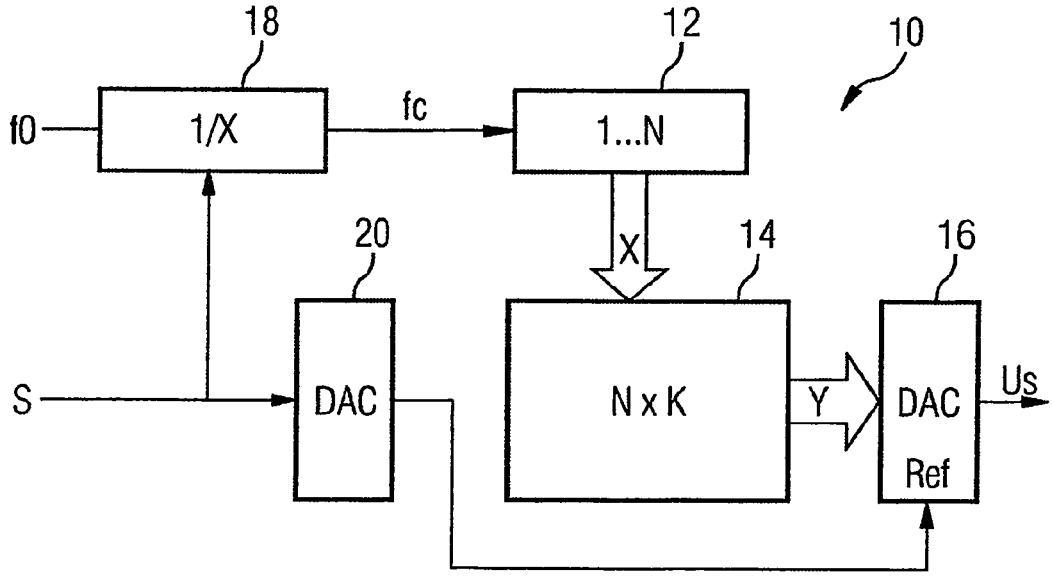
FIG. 4 shows a block diagram of a circuit configuration for generating different control signal waveforms for an engine control unit for controlling one or more fuel injectors.

FIG. 4 shows a circuit configuration, denoted overall by 10, for generating a control signal Us for an engine control unit for the control of fuel injectors, whereby the control signal Us generated is suitable within the framework of a regulated piezo control facility for predefining the piezo current reference value for the piezo voltage curves U1, U2 shown in FIGS. 1 to 3, as is described in the following.

The circuit configuration 10 includes a counter 12, supplied with a clock signal fc, which—triggered by a start signal which is not shown from an engine control electronics unit—counts the clock signal fc (from 1 to N) and provides a time-dependent digital counter signal X as the result of this counting. In the simplest case the signal X represents the number of clock signal periods executed up to the current point in time.

This digital counter signal X is entered into a memory 14 as an address input signal. In this memory 14, a series Y of digital control signal values Y1, Y2 . . . YN with a resolution of K bits which were stored in advance are output in succession to a digital-to-analog converter 16 depending on the counter signal X entered for addressing.

The digital-to-analog converter 16 converts the digital control signal values Y1, Y2 . . . into the analog control signal Us which is used in an engine control unit not shown in this figure as the predefined reference value for the piezo current to be output and consequently for the resulting (as the integral of the current) charge (and proportional to this, the piezo voltage Up).

The data stored in the memory 14, in this case a list or table with N control signal values each with K bits resolution (here: N=100, K=10) represents the desired, time-related reference value curve, determined in advance and optimized, for an injector control current intended for injector valve opening. For the valve closing operation, the same curve (inverted) or a different curve specially stored for this purpose in the memory 14 can be provided.

The concrete shape of the output signal Us here is also determined by two parameters. The first of these is the frequency of a permanently predefined clock signal f0 which is generated by a clock generator not shown in FIG. 4 and input by way of a divider 18 to the counter 12 as a frequency divided clock signal fc. The second of these is a digital scaling signal S (output by a microcontroller for example) which on the one hand is input directly to the divider 18 and whose division ratio is determined and on the other hand is input by way of a digital-to-analog converter 20 in analog form to a reference input Ref of the digital-to-analog converter 16. The scaling signal S thus serves on the one hand as a time scaling signal which on the basis of the division ratio dependent thereon of the divider 18 determines the clock for reading data from the memory 14 and thus the charging time period, and on the other hand as an amplitude scaling signal which is taken into consideration as a multiplicative parameter during the output-side conversion by the digital-to-analog converter 16.

If the circuit configuration according to FIG. 4 is operated with a permanently predefined basic frequency f0 but a variable scaling signal S, then the voltage curves U1 and U2 shown in FIG. 1 can be realized in a simple manner through appropriate setting of the scaling signal S (for example by the aforementioned microcontroller). The transition from the voltage curve U1 to the voltage curve U2 occurs for example as a result of halving the scaling value represented by the signal S.

The variation of the voltage curve illustrated in FIG. 2 can also be realized in a simple manner with the circuit configuration according to FIG. 4. In contrast to the operation with a fixed basic frequency f0, for a transition from the voltage curve U1 to the voltage curve U2 in FIG. 2 only an additional reduction in the frequency of the signal f0 input to the divider 18 needs to be provided here (in order to achieve the additional extension or slowing of the piezo voltage rise for the voltage curve U2). As an alternative or in addition, for the curve scaling according to FIG. 2 (deviating from the embodiment illustrated in FIG. 4) the time scaling signal fed to the divider 18 could also be chosen to be not equal to the amplitude scaling signal which is input to the converter 16 as a reference.

Finally, the variation of the voltage curve illustrated in FIG. 3 can also be realized with the circuit configuration according to FIG. 4, depending on the desired voltage curve, by not running through (outputting) the complete stored series of control signal values Y1, Y2 . . . YN but by skipping a middle range from this stored series (in FIG. 3 the range between t1 and t2).

For this purpose the counter 12 can be configured as controllable or programmable in such a manner that the output of control values for a middle range of addresses corresponding to a preselected control value amplitude is suppressed. The latter is done for example by combining the counter with a control logic which provides a modifiable code conversion of the signal X before it is output to the memory.

The circuit configuration 10 for realizing one of more of the control methods described with reference to FIGS. 1 to 3 (on the basis of an optimized control curve) can easily be implemented in hardwired logic, in other words particularly also without using a microcontroller, such that an extremely high speed of execution in the microsecond range can be attained. In this respect it is advantageous if when choosing the values N, K, S binary multiples are used which can then for example be set extremely rapidly by means of an appropriate bit shift operation.

Alternatively, the method can however also be realized with a microcontroller or a digital signal processor (DSP) if the realtime requirements are not excessively high. In this case, control circuit sections provided in the appropriate circumstances, for example for the piezo control voltage (or piezo charging), are easier to realize and reduce the need for analog circuitry, which makes the overall arrangement more cost-effective.

Figure 5:
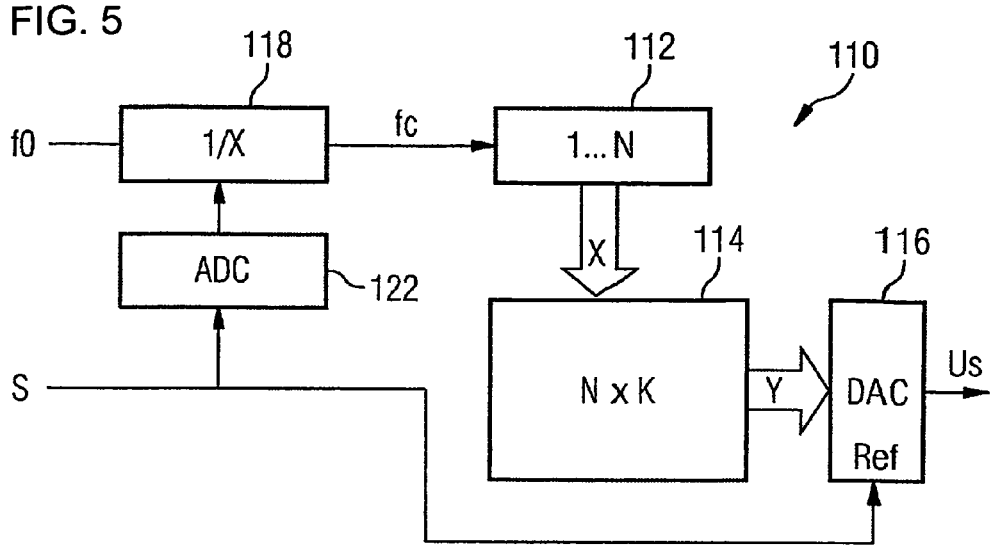
FIG. 5 shows a block diagram of a circuit configuration for generating different control signal waveforms for an engine control unit for controlling one or more fuel injectors in accordance with a further embodiment.
Figure 6:
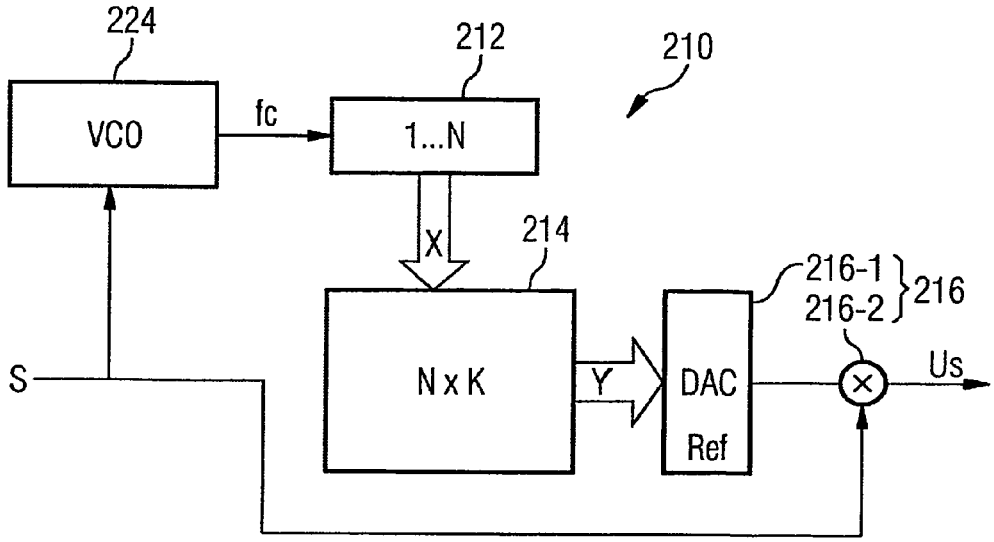
FIG. 6 shows a block diagram of a circuit configuration for generating different control signal waveforms for an engine control unit for controlling one or more fuel injectors in accordance with a further embodiment.

FIGS. 5 and 6 show two further modifications of the circuit configuration according to FIG. 4, whereby analog circuit components are denoted in these figures by the same reference numbers but are incremented by 100 (FIG. 5) or 200 (FIG. 6) in each case in order to differentiate the embodiments.

With regard to the modification according to FIG. 5, an analog scaling signal S is provided which is input in this form directly to the reference input Ref of the digital-to-analog converter 116 and by way of an analog-to-digital converter 122 in digital Form to the divider 118.

With regard to the modification shown in FIG. 6, in order to provide the clock signal fc a voltage controlled oscillator (VCO) 224 is used to which the scaling signal S is applied for setting the frequency. This signal S is also fed to an analog multiplier element 216-2 which is connected downstream of a digital-to-analog converter 216-1 and together with the latter forms the digital-to-analog converter unit 216.

Figure 7:
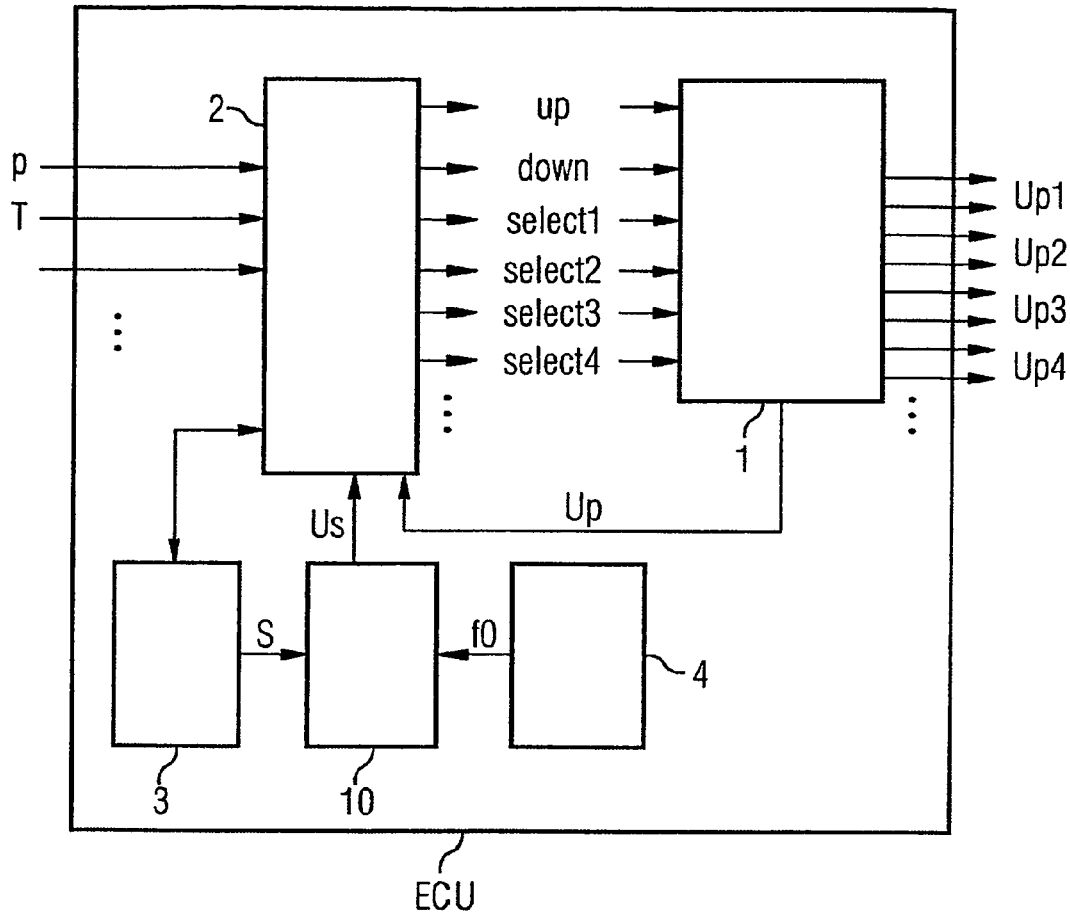
FIG. 7 shows a block diagram of an engine control unit in which a circuit configuration according to FIG. 4 is used for controlling piezo fuel injectors.

In a schematic block diagram, FIG. 7 illustrates the use of the circuit configuration 10 described above for the operation of a final stage 1 in an engine control unit ECU for the regulated charging and discharging of piezo elements in fuel injectors.

The engine control unit ECU includes the circuit configuration 10, which receives as its input on the one hand the basic clock signal f0 from an oscillator 4 and on the other hand the scaling signal S from a microcontroller 3. In the manner already described above, the circuit configuration 10 thereby generates an analog control signal Us which is fed to a control unit 2 of the engine control unit ECU as a predefined reference value.

Amongst other things, four selection signals select1 to select4 are generated by the control unit 2 and fed to the final stage 1. These signals select1 to select4 are initially used to select one of four fuel injectors immediately prior to a fuel injection.

The piezo control voltage (one of the voltages Up1 to Up4) is subsequently fed to the piezo element of the selected fuel injector. This process is initiated by the output of a PWM-modulated charging signal up from the control unit 2 to the final stage 1. In the final stage 1 the signal up is for example fed to the gate of a power MOSFET in order to switch the latter on in clocked mode for charging the corresponding piezo element. Control of the discharging of the piezo element is effected in analogous fashion through the generation of a corresponding PWM-modulated discharging signal down which is used for example to control a power MOSFET provided for discharging purposes.

The PWM control, in particular the pulse duty ratio of the charging and discharging signals up and down is based here on a control process by means of which an actual value (here: charging/discharging current Ip, alternatively for example: piezo voltage Up), which is representative of the control status of the injector currently being controlled, is compared in the control unit 2 with a corresponding predefined reference value (here: control signal Us provided by the circuit configuration 10), and the modulation of the signals up and down is set for bringing the actual value (piezo current actually flowing) into line with the reference value Us.

In order to take engine operating parameters into consideration during this controlled operation of the fuel injectors, parameters such as for example the pressure p in a fuel pressure reservoir, the temperature T of the fuel in the area of the injectors etc. are here fed as sensor signals to the control unit 2 and, involving the microcontroller 3 if the occasion arises, evaluated.

Although in the case of the embodiments described above the control signal Us represents the predefined value for a current to be output to a piezo element, this is however not restrictive for the invention. Rather, the control signal generated in accordance with the invention can also represent any other value representative of the control status or the control waveform for a fuel injector, in particular the charging status or charging/discharging voltage of a piezoelectric final control element.

I claim:

1. A circuit configuration for generating a control signal for an engine control unit controlling at least one fuel injector of an internal combustion engine, wherein operating parameters of at least one of the internal combustion engine and the fuel injector are used for generating a modification signal input to the circuit configuration for an operational variation of a course of the control signal, the circuit configuration comprising:

a counter device connected to receive a predefined clock signal for providing a time-dependent digital counter signal;

a memory device connected to receive the digital counter signal, said memory device being configuration to store a series of digital control signal values and to successively issue individual control signal values from the series of control signal values in dependence on the counter signal; and a digital-to-analog converter for converting the digital control signal values issued from said memory device into analog control signals for the engine control unit.

2. The circuit configuration according to claim 1, which comprises a voltage-controlled oscillator connected to receive the modification signal as a time scaling signal and generating the clock signal with the selected frequency.

3. The circuit configuration according to claim 1, which comprises an oscillator with a fixed oscillation frequency and a divider connected to an output of said oscillator for generating the clock signal with the selected frequency, said divider having a division ratio determined by the modification signal input to said divider as a time scaling signal.

4. The circuit configuration according to claim 1, wherein said memory device stores a series of at least 30 control signal values forming the series of control signal values.

5. The circuit configuration according to claim 1, wherein said memory device stores a series of at least 50 control signal values forming the series of control signal values.

6. The circuit configuration according to claim 1, wherein the series of control signal values stored in said memory device approaches a continuous function.

7. The circuit configuration according to claim 1, wherein the digital control signal values are provided with a resolution of at least 8 bits.

8. The circuit configuration according to claim 1, wherein said memory device is a read-only memory.

9. A method of generating a control signal for an engine control unit controlling at least one fuel injector of an internal combustion engine, wherein operating parameters of the internal combustion engine and/or of the fuel injector are used for generating a modification signal for an operational variation of a course of the control signal, the method which comprises:

counting a predefined clock signal and providing a time-dependent digital counter signal, wherein the clock signal is predefined with a frequency that is set in accordance with the modification signal;

successively issuing individual digital control signal values in accordance with the counter signal from a previously stored series of control signal value; and converting the issued digital control signal values into an analog control signal for the engine control unit, and taking the modification signal into account as an amplitude scaling signal in converting the digital control signal values into the analog control signal.

* * * * *